United States Patent [19]

Baker et al.

[11] Patent Number: 4,697,090

[45] Date of Patent: Sep. 29, 1987

[54] STARTING SYSTEM FOR AN ELECTRICALLY-COMPENSATED CONSTANT SPEED DRIVE

[75] Inventors: Robert C. Baker, Loves Park; Bryan W. Dishner, Roscoe, both of Ill.

[73] Assignee: Sundstrand Corporation, Rockford, Ill.

[21] Appl. No.: 945,875

[22] Filed: Dec. 23, 1986

[51] Int. Cl.[4] ..... F02N 11/04

[52] U.S. Cl. ..... 290/4 R; 290/38 R

[58] Field of Search ..... 290/4 R, 4 C, 32, 38 R

[56] References Cited

U.S. PATENT DOCUMENTS

| | | | |
|---|---|---|---|
| 3,809,914 | 5/1974 | Kilgore et al. | 290/32 X |
| 4,456,830 | 6/1984 | Cronin | 290/32 X |
| 4,481,459 | 11/1984 | Mehl et al. | 290/38 R X |
| 4,488,053 | 12/1984 | Cronin | 290/4 C |
| 4,572,961 | 2/1986 | Borger | 290/4 R |

*Primary Examiner*—William M. Shoop, Jr.
*Assistant Examiner*—W. E. Duncanson, Jr.
*Attorney, Agent, or Firm*—Wood, Dalton, Phillips, Mason & Rowe

[57] ABSTRACT

Prior generating systems utilizing electrically-compensated constant speed drives (ECCSD) have typically required a separate starter motor for starting a prime mover which supplies motive power to the ECCSD, thereby increasing the size and weight of the system. In order to overcome this problem, a generating system is provided with circuitry coupled to the electrical power windings of a permanent magnet machine (PMM) forming a part of the ECCSD for causing the PMM to develop motive power which causes an output shaft of a differential of the ECCSD to rotate at increasing speeds. When the output shaft of the differential reaches a predetermined speed, a generator coupled to the output shaft of the differential is supplied external or ground power which in turn causes the generator to operate as a motor and return motive power through the differential to the prime mover to start same and bring it up to operating speed.

14 Claims, 6 Drawing Figures

STARTING SYSTEM FOR AN ELECTRICALLY-COMPENSATED CONSTANT SPEED DRIVE

DESCRIPTION

1. Technical Field

The present invention relates generally to constant speed drive systems, and more particularly to a constant speed drive which may be operated in a starting mode to start a prime mover and bring it up to operating speed.

2. Background

Generating systems for generating electrical power from motive power supplied by a variable speed prime mover utilize either a constant speed drive or complex electrical power converter circuits to develop constant frequency alternating current power. An example of the prior type of system is disclosed in Dishner et al U.S. patent application Ser. No. 893,943, filed Aug. 6, 1986, entitled "Power Converter for an Electrically-Compensated Constant Speed Drive", assigned to the assignee of the instant application and the disclosure of which is hereby incorporated by reference.

The generating system disclosed in the above referenced Dishner et al patent application includes an electrically-compensated constant speed drive which converts variable speed motive power developed by a prime mover into constant speed motive power for driving a load, such as a generator. The constant speed drive includes a differential speed summer having a first input coupled to the output of the prime mover. The prime mover output is also coupled to a motive power shaft of a first permanent magnet machine. A second input of the differential is coupled to a motive power shaft of a second permanent magnet machine. Electrical power windings of the permanent magnet machines are interconnected by a power converter which manages the flow of power between the machines so that the second permanent magnet machine develops compensating speed of a magnitude and direction which causes the output shaft of the differential to be driven at a desired constant speed. The generator is coupled to the output shaft of the differential so that it provides constant frequency alternating current power.

In such systems, some type of means must be provided for starting the prime mover and bringing it up to operating speed. In some generating systems, separate starter motors are provided which are energized by a source of electrical power. It would be desirable to obviate the necessity for such a starter motor, if possible.

Power generating systems have been devised which do not utilize a starting motor to start and bring a prime mover up to operating speed. Cronin U.S. Pat. No. 4,401,938 discloses the use of an induction machine driven by an engine and which operates in a generating mode to develop polyphase AC power whereby excitation for the induction machine is provided by a permanent magnet generator which is driven by a toroidal differential drive coupled to the output of the engine. The apparatus is capable of use in a starting mode during which an engine starting circuit provides a programmed frequency and voltage to the induction machine to cause it to operate as a motor and thereby bring the engine up to operating speed.

Mehl U.S. Pat. No. 4,481,459, assigned to the assignee of the instant application, discloses an engine starting and generating system wherein a permanent magnet generator supplies control power to an exciter, which in turn provides field current to a main generator. The permanent magnet generator, exciter and main generator share a common rotor. This system is operated in a starting mode by providing power to the permanent magnet generator to cause it to rotate the common rotor at a particular speed, at which time power is applied to the main generator windings to cause it to operate as a motor and thereby deliver motive power through a torque converter to a prime mover. This in turn starts the prime mover and brings it up to operating speed.

Neither of the foregoing systems for starting a prime mover and bringing it up to operating speed is specifically adapted for use with a constant speed drive, and more particularly an electrically-compensated constant speed drive of the type disclosed in the above-referenced Dishner et al patent application.

DISCLOSURE OF INVENTION

In accordance with the present invention, a power generating system such as that disclosed in the above-referenced Dishner et al patent application is provided with circuitry to start the prime mover and bring it up to operating speed.

More specifically, a generating system of the type described above may be provided with means coupled to the electrical power windings of the second permanent magnet machine for operating such machine as a motor to thereby cause the differential output shaft to rotate at increasing speeds. Means are coupled to the generator and responsive to the differential output shaft achieving a predetermined speed for applying power to output windings of the generator to cause the generator to operate as a motor and thereby develop motive power which is returned through the differential to the prime mover output shaft to start the prime mover.

If desired, the power converter already utilized in the constant speed drive may be used in conjunction with an external power source to develop the power required by the second permanent magnet machine. Alternatively, a separate power converter circuit may be provided to supply the required power to the second permanent magnet machine. In either event, the prime mover may be started without the necessity of a separate starter motor and hence the overall power generating system may be made smaller and less complex than if a separate starter motor were used.

BRIEF DESCRIPTION OF THE DRAWING

FIGS. 4A–4C are graphs wherein FIG. 4A illustrates the operation of the circuitry shown in FIG. 3 for the condition where full starting torque is capable of being provided by the PMM1 and wherein FIGS. 4B and 4C illustrate the condition where the torque developed by the PMM1 is limited so that it is less than the required starting torque for the prime mover 16.

BEST MODE FOR CARRYING OUT THE INVENTION

Figure 1:
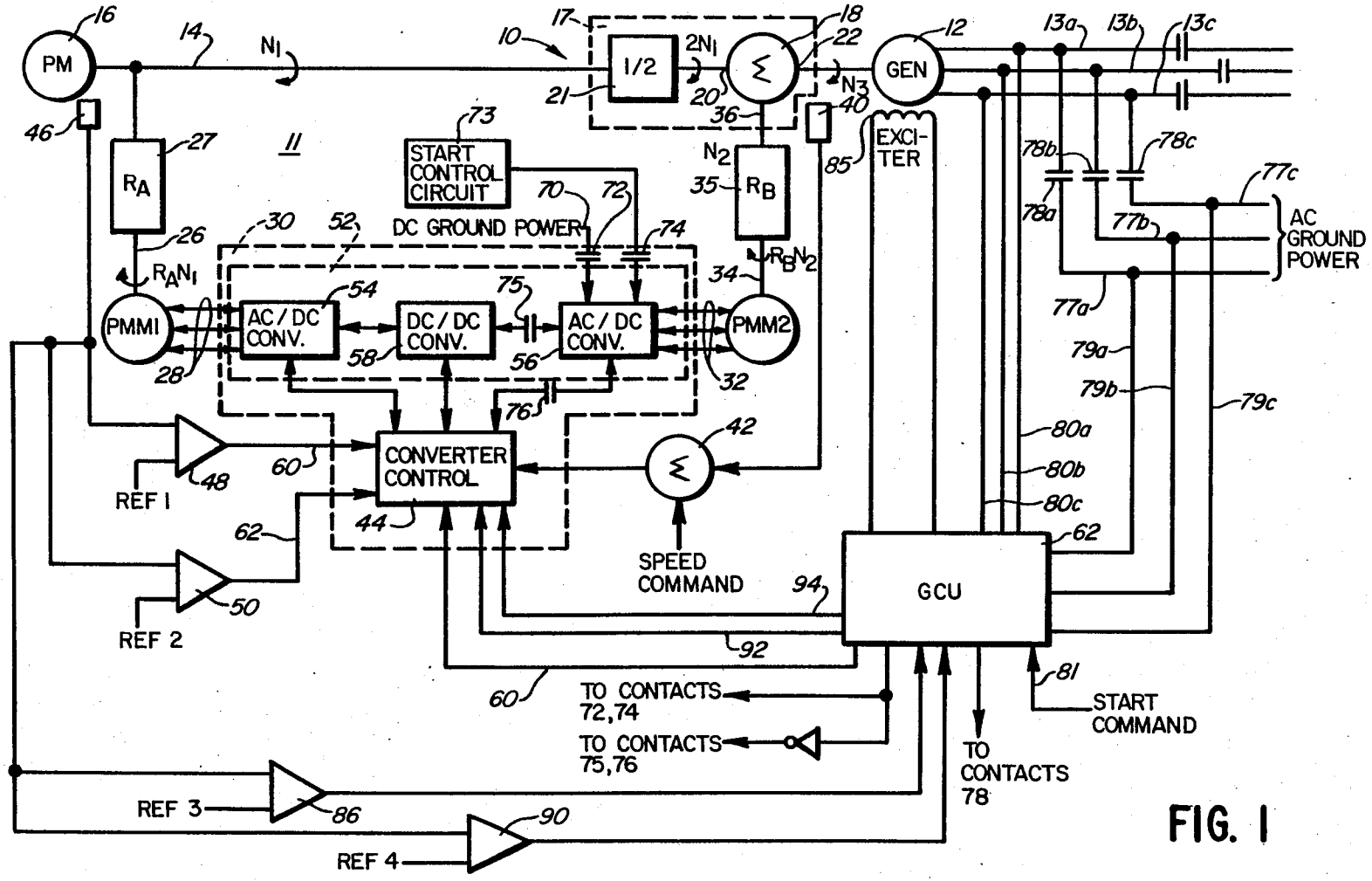
FIG. 1 is a block diagram of an electrically-compensated constant speed drive including the starting system of the present invention.

Referring now to FIG. 1, there is illustrated a generating system 10 which includes an electrically-compensated constant speed drive 11 for driving a generator 12 at a desired constant speed so that constant frequency AC main generator power is developed on power bus conductors 13*a*–13*c* to energize one or more loads (not shown). The constant speed drive 11 receives variable speed motive power from a shaft 14 which is driven by a variable speed prime mover 16. A gear box (not shown) may be coupled between the shaft 14 and the prime mover 16, if desired.

The shaft 14 is coupled to a mechanical differential 17 having a speed summer 18. A mechanical disconnect unit (not shown) may be coupled between the shaft 14 and the differential 17, if desired. The differential 17 accomplishes a 2:1 speed increase which is represented by a block 21. The speed summer further includes an output shaft 22 which is coupled to the generator 12.

A first or control permanent magnet machine PMM1 includes a motive power shaft 26 which is coupled by a gear box 27 to the output shaft 14. The PMM1 further includes electrical power windings which are coupled by a series of conductors 28 to a power converter 30.

A second or speed-compensating permanent magnet machine PMM2 includes electrical power windings which are coupled by a series of conductors 32 to the power converter 30. The PMM2 further includes a motive power shaft 34 which is coupled through a gear box 35 to a second input 36 of the differential speed summer 18.

The gear boxes 27,35 are speed multipliers having speed ratios of $R_A$ and $R_B$, respectively. More specifically, if $N_1$ is the speed of the output shaft 14, the speed of the motive power shaft 26 of the PMM1 is equal to $R_AN_1$. Likewise, if the speed of the shaft coupled to the input 36 of the speed summer 18 is $N_2$, then the speed of the motive power shaft 34 of the PMM2 is equal to $R_BN_2$.

The speed of the output shaft 22 of the speed summer 18 is detected by a speed sensor 40. The speed sensor 40 develops a speed signal which is coupled to one input of a summing junction 42. A second input of the summing junction 42 receives a speed command signal representing the desired output speed of the speed summer 18. The summing junction 42 substracts the two signals at the inputs and develops a speed error signal representing the difference between the actual output speed of the speed summer 18 and the commanded speed. The speed error signal is coupled to a converter control circuit 44 which is a part of the power converter 30.

The speed of the output shaft 14 is detected by a second speed sensor 46 which develops a signal representive thereof. This signal is coupled to noninverting inputs of first and second threshold comparators 48,50. The comparators 48,50 include inverting inputs which receive reference signals REF1 and REF2, respectively. The outputs of these comparators are coupled to the converter control circuit 44 in the power converter 30.

The power converter 30 further includes power switching circuitry 52 which is controlled by the converter control 44 so as to operate the system 10 in a generating mode of operation. In one embodiment of the electrically-compensated constant speed drive 11, the power switching circuitry 52 comprises a first bi-directional AC/DC converter 54 which is coupled to the electrical power windings of the PMM1 by the conductors 28, a second bi-directional AC/DC converter 56 coupled to the electrical power windings of the PMM2 by the conductors 32 and a bi-directional DC/DC converter 58 which is coupled between and interconnects the AC/DC converters 54,56.

The converter control 44 also receives an enable signal on a line 60 from a generator control unit (GCU) 62. The GCU controls the operational mode of the system (i.e. whether the system is operating the generating mode or in a starting mode) and controls the connection of the generator 12 to loads over a power distribution bus (not shown). The GCU may also operate the disconnect unit between the shaft 14 and the differential 17 in the event of a catastrophic failure of a component in the system.

While the generating system 10 is operating under normal operating conditions during which time the system is operating in the generating mode, the enable signal is provided over the line 60 to the converter control 44. In response to this enable signal, the converter control 44 operates the power converters 54–58 to in turn control the transfer of power between the permanent magnet machines PMM1 and PMM2 so that the speed-compensating machine PMM2 drives the shaft coupled to the input 36 at a speed and in a direction which causes the speed of the output 22 to be maintained at a desired speed.

The comparators 48,50 vary the operation of the converter control circuit 44 and the power switching circuitry 52 in dependence upon the speed $N_1$ of the shaft 14. More specifically, the speed $N_1$ may be such that it is necessary to operate the PMM1 as a generator and the PMM2 as a motor to provide compensating speed to the input 36 of the speed summer 18. In this case, the converter 54 is operated as a full bridge rectifier while the converter 56 is operated as an inverter under control of the converter control circuit 44.

On the other hand, the speed $N_1$ may be such that the PMM2 must be operated as a generator and the PMM1 must be operated as a motor, in which case the converter 56 is operated as a rectifier while the converter 54 is operated as an inverter.

Furthermore, the operation of the DC/DC converter 58 is varied as a function of the speed $N_1$ so that the proper voltage is applied to the converter 54,56 which is operating as an inverter.

It should be noted that if the range of speeds of the shaft 14 is limited with respect to the desired output speed $N_3$ such that the speed $2\times N_1$ is always either below or above the speed $N_3$, the power converters 54,56,58 and the converter control circuit 44 may be replaced by greatly simplified circuits which are unidirectional in nature. For example, the converters 54–58 may be replaced by a phase-controlled rectifier and an inverter coupled between the power windings 28,32 of the machines PMM1,PMM2, respectively. In this case, the converter control 44 would be replaced by a different control for operating the switches in the phase-controlled rectifier circuit and the inverter so that the PMM1 is always operated at a generator and the PMM2 is always operated as a motor.

A more complete description of the operation of the electrically-compensated constant speed drive illustrated in FIG. 1 is contained in the above-referenced Dishner et al application.

The GCU 62 controls the application of external or ground power to the PMM2 and the generator 12. More specifically, one or more conductors 70 and contactors 72 connect a source of DC ground power or another DC source to the AC/DC converter 56. A start control circuit 73 is coupled by contactors 74 to the AC/DC converter 56 to control same when the system is operating in the starting mode, during which time a pair of contactors 75 and 76 are opened to disconnect the DC/DC converter 58 and the converter control 44 from the AC/DC converter 56. As noted more specifically below in connection with a further embodiment of the invention, the function of the start control circuit 73 may be assumed by the converter control 44, in which case the circuit 73 and the contactos 74 and 76 are not required.

Also, while the start control circuit 73 is illustrated as separate from the GCU 62, it should be understood that this circuit may be a part of the GCU, if desired.

A series of conductors 77*a*–77*c* and contactors 78*a*–78*c* connect an external or ground source of AC power to the power bus conductors 13*a*–13*c*. The conductors 13 are in turn coupled to the armature windings of the generator 12. The GCU 62 senses the AC ground power and the voltages on the lines 13*a*–13*c* over lines 79*a*–79*c* and 80*a*–80*c*, respectively, and controls the contactors 78*a*–78*c* in accordance with such sensing, as noted in greater detail below.

The GCU 62 is responsive to a start command issued by an operator on a line 81. The start command, when issued, causes the GCU 62 to close the contactors 72 and 74 and to open the contactors 75 and 76. Power is thereafter developed on the lines 32 which is delivered to the PMM2 to cause it to operate as a motor. The start control circuit 73 controls the voltage and frequency of the power on the lines 32 to cause the PMM2 to be driven at increasing speeds until the speed $N_2$ reaches a predetermined speed. Specifically, the GCU 62 senses the power on the lines 13*a*–13*c* and 77*a*–77*c* to determine when a particular speed summer output speed is reached whereby the frequency and voltage of the power developed by the generator armature windings is the same as the frequency and voltage of the AC ground power. In the preferred embodiment, the PMM2 is driven such that the speed $N_3$ of the output shaft 22 of the speed summer 18 reaches the synchronous speed of the generator 12, although this need not be the case if the ground power frequency is different than the normal generator output frequency. Once this condition is reached, the contactors 78*a*–78*c* are closed and AC ground power is applied to the armature windings of the generator 12. The GCU controls the field current delivered to an exciter field winding 85 so that the generator 12 then begins to operate as a motor. The generator thereafter develops motive power which is returned through the differential 17 and the prime mover output shaft 14 to the prime mover 16 to start same and bring it up to operating speed.

It should be noted that during the starting procedure, the enable signal on the line 60 is removed from the converter control 44. In response to this removal of the enable signal, the converter control 44 opens the switches in one or more of the power converters 54 and 58 so that these converters are disabled. The use of this enable signal is not disclosed in the above-referenced Dishner et al patent application; however, given the disclosure of this application, it is a simple matter to design the converter control 44 to accept and use such signal and to design a GCU which develops such signal, and hence further disclosure in this regard is not believed necessary.

Once the generator 12 develops motive power and delivers torque to the differential, the PMM2 is operated by the start control circuit 73 so that it develops torque equal in magnitude to the torque developed by the generator 12. The direction of the torque developed by the PMM2 is such as to cause starting torque to be developed at the input 20 so that the speed of the shaft 14 increases in the desired direction.

A level comparator 86 develops a high state signal when the speed of the prime mover 16, as detected by the speed sensor 46, exceeds a predetermined or starting speed represented by a reference signal REF3. The high state signal developed by the level comparator 86 is detected by the GCU 62, which in turn opens the contactors 72,74,78 and closes the contactors 75,76. The AC ground power and DC ground power are thus disconnected from the generator armature windings and the AC/DC converter 56 and the converter 56 is coupled to the DC/DC converter 58 and the converter control 44. The GCU 62 thereafter issues an enable signal over the line 60 when the normal operating speed of the prime mover 16 is reached so that the converter control 44 operates the converters 54,56,58 to manage the flow of power between the machines PMM1 and PMM2. The detection of when the normal operating speed is reached is accomplished by sensing the output of a further level comparator 90 which develops a high state signal when the speed of the prime mover 16 exceeds a reference speed represented by a further reference signal REF4.

Once the converters 54,56,58 are under control of the converter control circuit 44, the generating system 10 is in the generating mode and the GCU 62 controls the exciter field current in a known fashion.

The operation of the GCU 62 in the generating mode will not be described in greater detail, it being understood that this operation is conventional in nature.

It should be noted that a separate power converter may be used instead of the converter 56 to control the PMM2 in the starting mode, if desired. In this case, it may be necessary to disconnect the converter 56 from the PMM2 when operating in the starting mode.

Further, the ground or external power may be provided by single or separate power supplies, as desired.

In an alternativ embodiment of the invention briefly described hereinbefore, the function of the start control circuit 73 is incorporated into the GCU 62 so that the start control circuit 73 and the contactors 74 and 76 are not required. In this case, the converter control 44 effects a normal operational control in which the output speed of the differential 17 is controlled. During this time, the output speed $N_3$ of the differential 17 as detected by the sensor 40 is compared against the speed command by the summing junction 42 and the resulting speed error is utilized by the converter control 44 to operate the switches in the converter 56 to minimize the error. This normal control is used during start-up prior to the time that the generator 12 is brought into synchronism with the AC ground power on the lines 77 and is also used during normal operation of the constant speed drive while in the generating mode.

A further operational control referred to as a "torque control" is effected by the converter control 44 during the start-up sequence after the contactors 78*a*–78*c* have been closed. During this time, the generator develops torque at the shaft 22 which must be balanced by an equal torque on the shaft 36. This balancing torque which must be developed by the PMM2 is a braking torque, and hence power flow occurs from the differential and the PMM2 into the converter 56. During this torque control, the converter control circuit 44 responds to a torque command from the GCU 62 over a line 92 and the error signal from the summing junction 42 is ignored. The torque command signal issued by the GCU 62 may be constant or could be a function of the prime mover speed or other parameters in the system.

The GCU operates the converter control circuit 44 in the normal control or torque control operation in dependence upon the state of a signal developed by the GCU 62 and transmitted over a line 94. In this embodiment, the GCU does not disable the converter control 44 and hence the line 60 is not needed and the control 44 is continuously operative. Further, the converter control 44 should not only be capable of normal operational control during start-up and steady state operation and be capable of torque control during start-up but should also be capable of disabling the switches in one or more of the converters 54,56,58 in the event of a fault.

Also, it should be noted that the speed command signal coupled to the summing junction 42 as well as the torque command signal previously mentioned may be developed by the GCU 62 so that the GCU may account for variations in AC ground power frequency and torque requirements for starting of the prime mover. The torque command signal may be derived from a look-up table or may be derived in another fashion, as desired.

Figure 2:
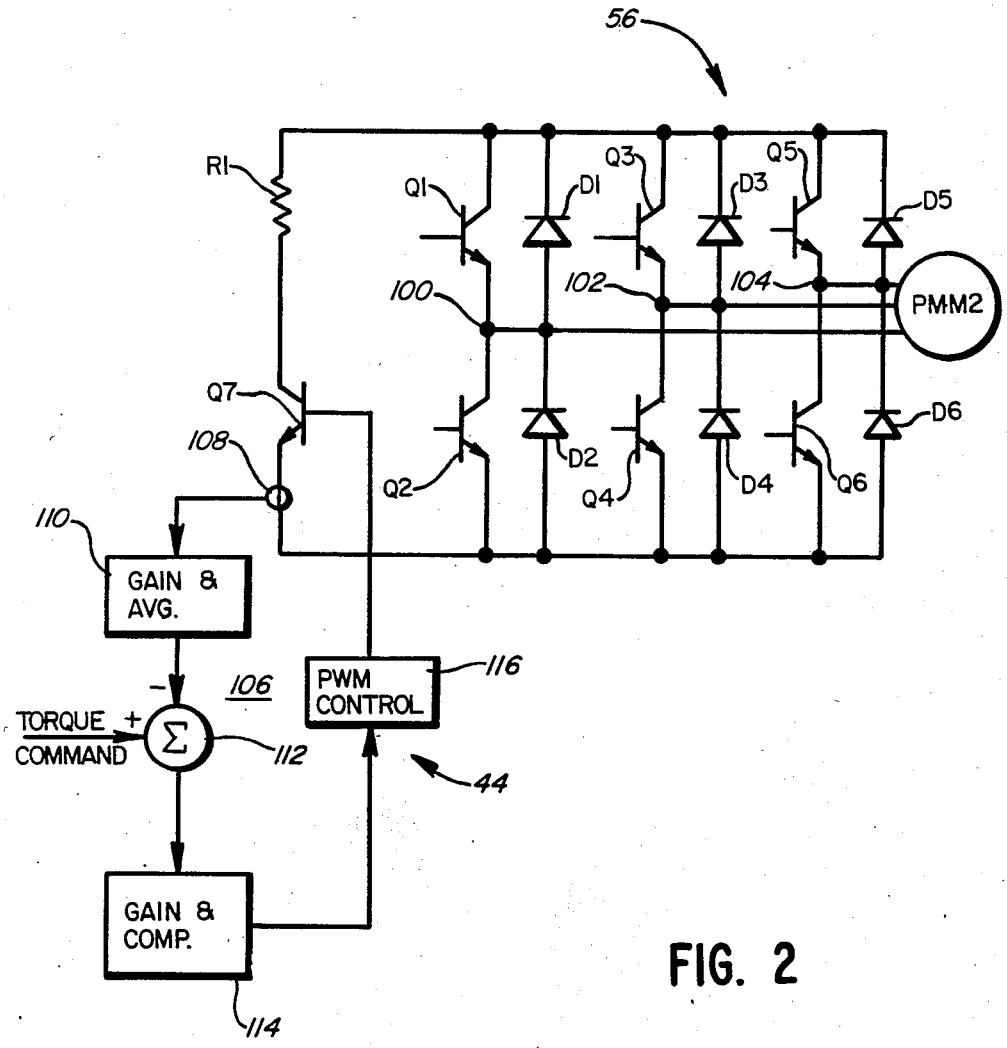
FIG. 2 is a combined block and schematic diagram of the AC/DC converter 56 and a portion of the converter control 44 shown in FIG. 1.

Referring now to FIG. 2, there is illustrated a first way in which the torque developed by the PMM2 can be controlled in response to the torque command signal developed by the GCU 62. In general, the circuitry shown in FIG. 2 dissipates the power developed by the PMM2 so that the PMM2 develops the appropriate amount of braking torque to start the prime mover 16.

More specifically, the electrical power windings of the PMM2 are coupled to junctions 100,102,104 between pairs of power switches Q1 and Q2, Q3 and Q4, and Q5 and Q6 in the AC/DC converter 56. Flyback diodes D1–D6 are coupled across the switches Q1–Q6, respectively. A resistor R1 and a further power switch Q7 are connected across the pairs of power switches Q1–Q6. The transistor Q7 is operated by a switch control circuit 106 which is a part of the converter control 44. The switch control circuit 106 includes a current sensor 108 which senses the current flowing through the power switch Q7. The signal developed by the current sensor 108 is processed by a gain and averaging circuit 110. As noted in greater detail below, the current through the power switch Q7 is pulse width modulated. Hence, in order to obtain a DC signal representing the current through the power switch Q7, the gain and averaging circuit 110 detects the average current level and develops a signal representative thereof which is coupled to a first input of a summing junction 112. The summing junction 112 subtracts the signal developed by the gain and averaging by the GCU 62. The resulting signal is a torque error signal which is processed by a gain and compensation circuit 114 and applied to a PWM control circuit 116. The PWM control circuit 116 controls the duty cycle of the power switch Q7 in dependence upon the processed torque error signal so that the average current flowing through the power switch Q7 and the resistor R1 is maintained at a level which causes the PMM2 to develop the command torque.

Figure 3:
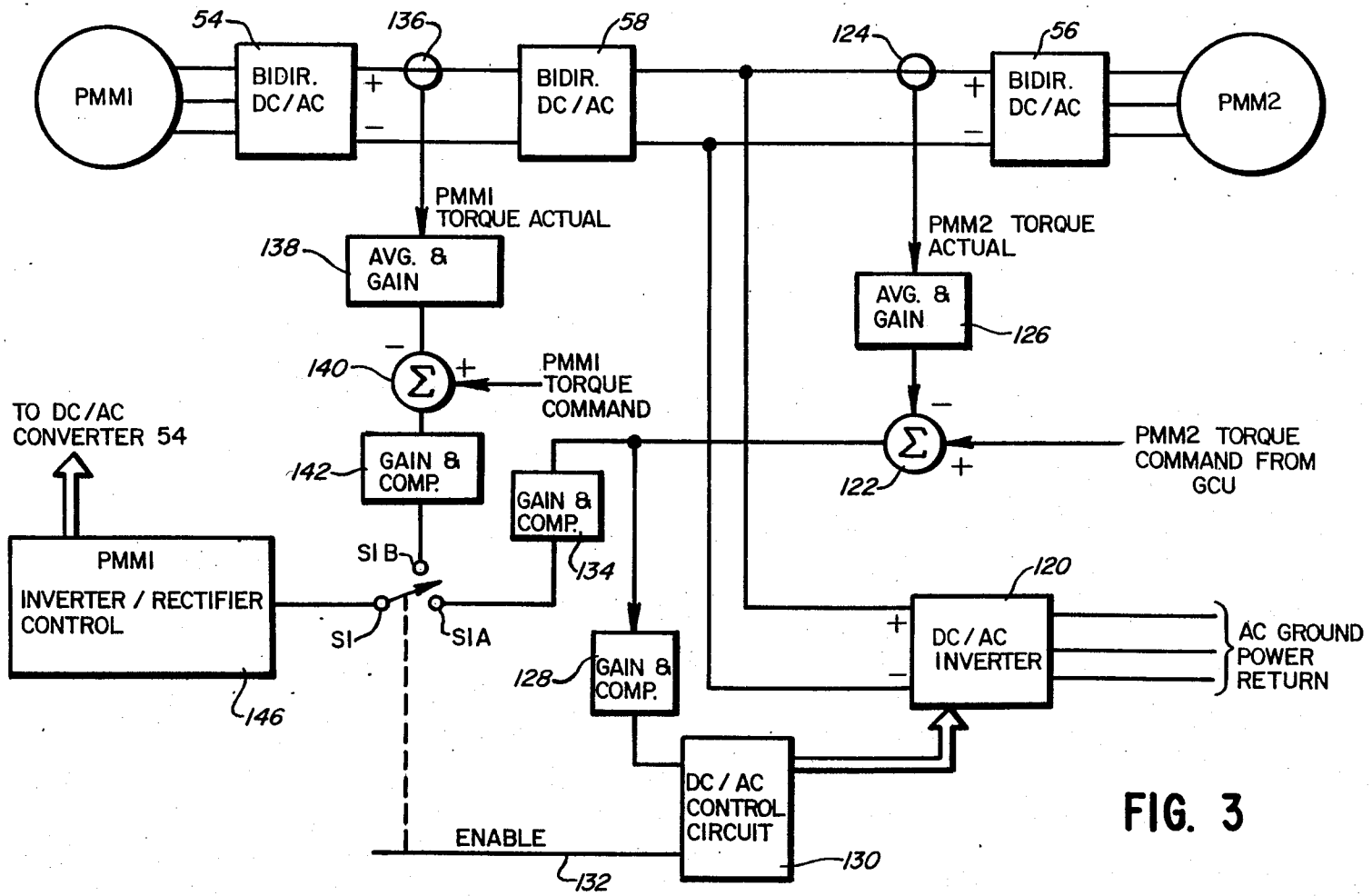
FIG. 3 is a block diagram of the power converter 52 together with circuitry forming a part of the converter control 44 comprising a preferred embodiment of the present invention.

From the foregoing discussion, it should be evident that the circuitry illustrated in FIG. 2 implements a purely dissipative technique for placing a load on the PMM2 so that it develops the required torque. Alternate circuitry for accomplishing this result is illustrated in FIG. 3. Briefly, in this embodiment the electrical power developed by the PMM2 is delivered to the PMM1 and/or returned to the AC ground power through a DC/AC converter 120. By returning power to the PMM1, additional starting torque is developed and delivered to the prime mover which in turn reduces the torque requirements placed upon the PMM2. As compared with the dissipative technique described above, this circuitry conserves power and hence is more desirable.

The torque command from the GCU 62 is compared by a summing junction 122 against a signal representing the average current at the output of the AC/DC converter 56 as developed by a current sensor 124 and a gain and averaging circuit 126. The resulting torque error signal is processed by a gain and compensation circuit 128 and is coupled to a first input of a DC/AC converter control circuit 130. The control circuit 130 also receives an enable signal over a line 132 which is in a high state during operation in the starting mode before the prime mover speed reaches a condition known as "cross-over", described in greater detail below. When the enable signal on the line 132 is high, the converter control circuit 130 operates switches in the DC/AC converter 120 to return power from the AC/DC converter 56 to the AC ground power source. When the enable signal is low, the DC/AC converter is disabled.

The output of the summing junction 122 is also coupled by a further gain and compensation circuit 134 to a first contact S1A of a switch S1. A second contact S1B receives a PMM1 torque error signal from a current sensor 136, a gain and averaging circuit 138, a summing junction 140 and a gain and compensation circuit 142. The summing junction 140 develops the error signal by subtracting the sensed torque from a constant torque command signal.

The switch S1 is operated in accordance with the enable signal on the line 132 to connect the signal from the circuit 142 to an inverter/rectifier control circuit 146 which controls the AC/DC converter 54 in accordance with the compensated torque error signal from the circuit 142 below the cross-over speed. The PMM1 is thereby operated to provide constant torque to the prime mover 16 below cross-over.

Above the cross-over speed, the switch S1 connects the contact S1A to the inverter/rectifier control circuit 146 so that the PMM1 is operated in accordance with the PMM2 torque error signal.

In the embodiment illustrated in FIG. 3, all of the power developed by the PMM2 may be coupled to the PMM1 and no power returned to the AC ground power provided that the PMM1 is capable of developing all of the starting torque required to bring the prime mover up to starting speed. If, however, the torque developed by the PMM1 is limited so that it is less than the required starting torque, at least a portion of the power from the PMM2 must be diverted away from the PMM1. The preferred way in which this is accomplished is through the use of the AC/DC converter 120, although other techniques might be devised, such as a dissipative scheme similar to that illustrated in FIG. 2 or a different technique which utilizes the power for other purposes.

Figure 4A:
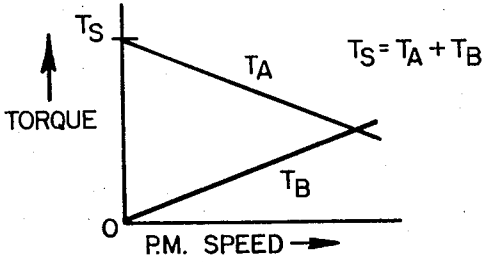
Figure 4B:
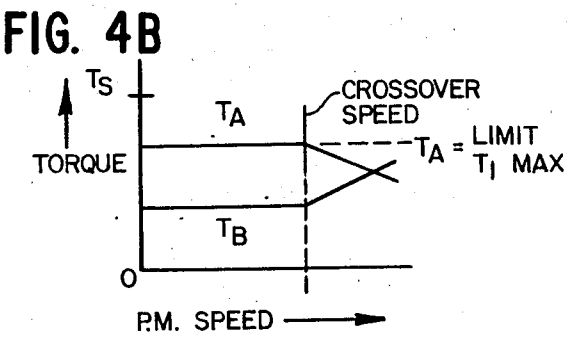
Figure 4C:
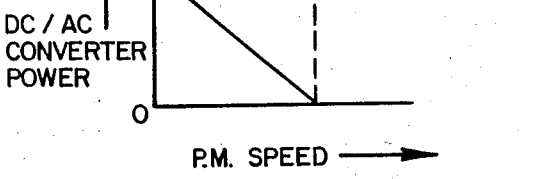

Referring now to the diagrams of FIGS. 4A–4C, in the event that PMM1 can supply full starting torque, and under the assumption that the starting torque is constant then the PMM1 torque $T_A$ starts at an initial value while the PMM2 torque $T_B$ is near zero at zero prime mover speed. Since the starting torque is equal to the sum of the torques $I_A$ and $I_B$, the starting torque at zero prime mover speed is substantially at the initial value of $T_A$ and thereafter the torque $T_A$ decreases linearly while the torque $T_B$ increases linearly as prime mover speed increases.

The diagram of FIG. 4B illustrates the condition wherein the PMM1 torque capacity is limited and power is returned to the AC ground power source through the DC/AC converter 120. In this case, the torque $T_A$ developed by the PMM1 is constant as is the torque developed by the PMM2 until the cross-over speed of the prime mover is reached. As shown in FIG. 4C, below the cross-over speed, the PMM2 develops more power than can be handled by the PMM1 and hence the excess power developed by the PMM2 is delivered to the DC/AC converter 120. As the prime mover speed increases, the speed of PMM1 also increases and the speed of PMM2 decreases. Eventually, at the cross-over speed, the power developed by PMM2 equals that which can be handled by PMM1 and no power is returned to the AC ground power source.

Beyond the cross-over speed, the torque developed by the PMM2 increases while the torque developed by the PMM1 decreases. All of the power developed by the PMM2 is coupled to the PMM1.

As should be evident, instead of delivering the power developed by the PMM2 to the PMM1, all of the PMM2 power may be delivered to the AC ground power source, if desired.

While the starting system disclosed herein is particularly adapted for use with the constant speed drive disclosed in the above-referenced Dishner at al application, the system may alternatively be used in other drive systems having a differential coupled between a prime mover and a generator, if desired.

We claim:

1. A starting system for an electrically-compensated constant speed drive (ECCSD) which develops constant speed motive power from variable speed motive power developed by a prime mover, the ECCSD including a first permanent magnet machine having a motive power shaft coupled to an output shaft of the prime mover, a differential speed summer having a first input shaft coupled to the output shaft of the prime mover, a second input shaft coupled to a motive power shaft of a second permanent magnet machine and an output shaft coupled to a generator and a power converter interconnecting electrical power windings of the first and second permanent magnet machines, comprising:

means coupled to the electrical power windings of the second permanent magnet machine for operating the second permanent magnet machine as a motor to thereby cause the differential output shaft to rotate at increasing speeds; and means coupled to the generator and responsive to the differential output shaft speed achieving a predetermined speed for applying power to windings of the generator to cause same to operate as a motor and thereby develop motive power which is returned through the differential and the prime mover output shaft to the prime mover to start same.

2. The starting system of claim 1, wherein the operating means comprises a generator control unit.

3. The starting system of claim 1, wherein the power converter includes an AC/DC converter coupled to the electrical power windings of the second permanent magnet machine and further including a start control circuit coupled to the AC/DC converter for controlling the application of external power by the AC/DC converter to the electrical power windings of the second permanent magnet machine.

4. The starting system of claim 3, further including a generator control unit (GCU) separate from the start control circuit and contactors operated by the GCU for connecting the start control circuit to the AC/DC converter.

5. The starting system of claim 4, wherein the power converter includes a DC/DC converter and a converter control and further including contactors operated by the GCU and coupled between the converter control and the AC/DC converter and between the DC/DC converter and the AC/DC converter wherein such contactors are opened when the start control circuit is connected to the AC/DC converter by the GCU.

6. The starting system of claim 1, wherein the applying means includes a set of contactors controlled by a generator control unit when the generator develops electrical power at a frequency and voltage which are the same as the frequency and voltage, respectively, of the applied power.

7. The starting system of claim 1, wherein the generator receives field current from an exciter and wherein the applying means includes a generator control unit for controlling field current delivered to the exciter.

8. A method of starting a prime mover coupled to a first input shaft of a differential speed summer having a second input shaft coupled to a permanent magnet machine and an output shaft coupled to a generator, the permanent magnet machine having electrical power windings, the method comprising the steps of:

(a) applying external power to the electrical power windings to operate the permanent magnet machine as a motor to thereby cause the differential output shaft to rotate at increasing speeds;

(b) detecting when the differential output shaft reaches a predetermined speed;

(c) applying external power to armature windings of the generator and controlling the generator excitation so that the generator operates as a motor to develop motive power; and (d) operating the permanent magnet machine such that motive power is developed at the first input shaft of the differential which is returned to the prime mover to start same.

9. The method of claim 8, wherein an AC/DC converter is coupled to the electrical power windings of the permanent magnet machine and wherein the steps (a) and (d) each include the step of controlling the AC/DC converter to in turn operate the permanent magnet machine.

10. The method of claim 8, wherein the step (d) includes the step of causing the permanent magnet machine to develop torque at a magnitude equal to the magnitude of torque developed by the generator.

11. The method of claim 10, wherein the step (d) includes the further step of controlling the permanent magnet machine in accordance with a torque command signal.

12. A method of starting a prime mover coupled to an electrically-compensated constant speed drive (ECCSD) which develops constant speed motive power from variable speed motive power developed by the prime mover, the ECCSD including a first permanent magnet machine having a motive power shaft coupled to an output shaft of the prime mover, a differential speed summer having a first input shaft coupled to the output shaft of the prime mover, a second input shaft coupled to a motive power shaft of a second permanent magnet machine and an output shaft coupled to a generator and a power converter interconnecting electrical power windings of the first and second permanent magnet machines, the method comprising the steps of:

(a) applying external power to the power converter to operate the second permanent magnet machine as a motor to thereby cause the differential output shaft to rotate at increasing speeds;

(b) detecting when the differential output shaft reaches a predetermined speed; and (c) applying external power to armature windings of the generator and controlling the generator excitation so that the generator operates as a motor to develop motive power which is returned through the differential to the prime mover to start same.

13. The method of claim 12, wherein the power converter includes an AC/DC converter coupled to the electrical power windings of the second permanent magnet machine and wherein the step (a) includes the step of controlling the AC/DC converter by means of a start control circuit so that the external power is provided in controlled fashion to the second permanent magnet machine.

14. The method of claim 13, wherein the power converter further includes a DC/DC converter and a converter control and wherein the step (a) includes the step of opening contactors between the DC/DC converter and the AC/DC converter and between the converter control and the AC/DC converter.

* * * * *